US005879252A

United States Patent [19]

Johnson

[11] Patent Number: 5,879,252

[45] Date of Patent: Mar. 9, 1999

[54] ARROWHEAD

[76] Inventor: Gregory G. Johnson, 3417 Longfellow Ave. South, Minneapolis, Minn. 55407

[21] Appl. No.: 935,101

[22] Filed: Sep. 25, 1997

Related U.S. Application Data

[63] Continuation-in-part of Ser. No. 452,424, May 26, 1995, abandoned, which is a continuation of Ser. No. 184,051, Jan. 21, 1994, abandoned.

[51] Int. Cl.[6] ..... F42B 6/08

[52] U.S. Cl. ..... 473/583

[58] Field of Search ..... 473/578, 582, 473/583, 216, 219, 221

[56] References Cited

U.S. PATENT DOCUMENTS

| | | | |
|---|---|---|---|
| 2,993,697 | 7/1961 | Urban | 473/583 |
| 4,565,377 | 1/1986 | Troncoso et al. | 473/584 |
| 4,579,348 | 4/1986 | Jones | 473/583 |
| 5,066,021 | 11/1991 | DeLucia | 473/583 |
| 5,078,407 | 1/1992 | Carlston et al. | 473/583 |
| 5,090,709 | 2/1992 | Johnson | 473/584 |
| 5,100,143 | 3/1992 | Puckett | 473/583 |

*Primary Examiner*—John A. Ricci
*Attorney, Agent, or Firm*—Hugh D. Jaeger

[57] ABSTRACT

An arrowhead for a target and hunting arrow that includes a plurality of pivoting sharpened blades having actuating tips that move from a closed folded position to an open and extended position as the arrowhead penetrates the target or game. The blades increase the cutting action of the arrowhead and prevent the arrowhead from passing through the target or game. Each blade can be of the same geometrical configuration.

22 Claims, 10 Drawing Sheets

ARROWHEAD

CROSS REFERENCES TO CO-PENDING PATENT APPLICATIONS

This patent application is a continuation-in-part of Ser. No. 08/452,424 entitled "Arrow" filed on May 26, 1995, by the same inventor, now abandoned, which is a continuation of Ser. No. 08/184,051 entitled "Arrow" filed on Jan. 21, 1994, which is abandoned.

BACKGROUND OF THE INVENTION

1. Field of the Invention

The present invention relates to projectiles, such as arrows usable with large game bows, having heads with a plurality of expandable blades.

2. Description of the Prior Art

Conventional arrows have arrowheads with one or more fixed blades. The cutting ability of these arrows is limited, which often results in a superficial wound or a wound causing the hunted game to slowly bleed to death or suffer. Also, conventional arrows have a tendency to pass through the game or other target without expending all their kinetic energy, resulting in lost arrows and lost game. The term "game" refers to wild animals, fowl and fish.

Advancements in bow technology and the introduction of graphite or carbon fiber arrows have dramatically increased the speed at which it is possible to deliver an arrow. Conventional arrowheads with protruding blades become inaccurate at these higher speeds because of the effects of air on the exposed blades. This leads to inaccurate placement of the arrow and an increase in unrecovered and wounded animals. In an effort to make these "winged" arrowheads more accurate at higher speed, manufacturers have been reducing the cutting diameter of the average conventional broadhead. This has resulted in a greater percentage of arrows that pass through game completely and continue on for some distance. The result is that a lot of the additional potential cutting energy generated by the new high performance bows is not efficiently utilized for cutting. There is a need for an arrowhead that flies accurately at high speed yet delivers at the same time a large cutting diameter to dispatch game cleanly and quickly and take advantage of the increased energy of today's bows.

Prior hunting arrowheads have been provided with deployable blades. For example, the Pucketts Bloodtrailer U.S. Pat. No. 5,112,063 and the Delucia U.S. Pat. No. 4,976,443 describe arrowheads which are deployed by engagement of a plunger mechanism. These heads do not penetrate game well because of the mechanics of blade opening and the necessary blunt profile of the plunger tip and the accommodating bodies. They are structurally weaker because of the hollow body design. A further objection to these heads is that they don't provide any additionally cut size relative to conventional broadheads. Necessary lightweight construction requires that most hunting arrowheads are made of aluminum material, which is malleable. The blades on these designs use the body of the arrowhead as a stop, but the blades readily cut through the malleable aluminum of the arrowhead body on impact with something hard such as bone. This leads to malfunction of the arrowhead on game and more lost game, and it renders the arrowhead useless.

Prior arrowheads have been provided, with movable cutting blade structure that cooperates with one or more fixed blades to cut game or a target. For example, B. H. Steinbacher, U.S. Pat. No. 2,568,417, discloses an arrowhead assembly having fixed blades and a pair of pivoting blades located between the fixed blades. The pivoting blades move in a rearward direction to an open position when the arrowhead enters the game or target. Additional hunting arrows having expandable cutting blades are shown by E. P. Cox in U.S. Pat. No. 3,738,657 and R. S. Vocal in U.S. Pat. No. 4,615,529.

Another representative patent is by Johnson, U.S. Pat. No. 5,090,709, issued on Feb. 25, 1992, entitled "Arrowhead With Extendable Blades," the same inventor as this patent application.

The present invention also enhances the Johnson '709 patent. What is provided is an aerodynamically designed retractable-blade arrowhead with offset blades and a sturdier backstop made of steel or like material that does not significantly increase the overall weight of the arrowhead, and that is, further, replaceable so that the arrowhead may be reusable. A backstop that will stop rearward movement of the blades even when striking the toughest bones is provided to prevent the blades from pivoting past the desired stopping points so that the cutting diameter does not become reduced.

All other deployable-blade arrowheads have blades held in slots that form a plane that contains the centerline of the arrowhead. In this configuration the slot depth is limited by the center axis of the arrowhead and it is not possible to contain three or more blades generally within the arrowhead body (at the same distance back from the tip) without significantly increasing the arrowhead width or excessive structural weakening. Arrowheads with stationary offset blades are described in Kosbab, U.S. Pat. No. 4,210,330, but there is no known deployable-blade arrowhead with blades held in slots which are offset relative to the central axis of the arrowhead.

This design feature of the present invention allows sufficient slot depth to accommodate as many as six blades generally within the arrowhead body without excessively compromising its strength. Furthermore, it causes the arrowhead to twistingly penetrate game, and with a spinning arrow, drag and turbulence from exposed blade portions is reduced and blade opening is quickened. The arrow rotation during flight is enhanced due to air flow over the shaft body imparting forces upon the exposed portions of the blade and triangular actuating tip.

SUMMARY OF THE INVENTION

The general purpose of the present invention is to provide an arrowhead for a target and hunting arrow that has a plurality of pivoting sharpened blades, referred to simply as blades, and having triangular actuating tips, that move from a closed folded position during flight to an open and extended position as the arrowhead penetrates the target or game. During flight the triangular actuating tips and the exposed portions of the blades assist in generating rotational forces to enhance arrow spin. The blades increase the cutting action of the arrowhead and prevent the arrowhead from passing through the target or game. The combined cuts of the blades and the arrow tip cause rapid hemorrhaging of the game with quick death.

An arrowhead includes a tubular body for connecting to a shaft of an arrow. The tubular body includes longitudinally aligned slots accommodating the blades. The plurality of longitudinal slots are offset relative to the longitudinal axis and extend into and along the length of the tubular body. The plane of the slot does not contain the centerline of the tubular body and hence is "offset" from the centerline. The surface blades are flat knife blades having sharpened cutting edges which are deployed during impact after impact of the flat actuating tips. Pins pivotally connect the blades to the tubular body to allow the blades to swing rearwardly out of the slots to extended and deployed positions. A replaceable stopwasher aligned axially with the tubular body engages the blades to limit the rotational position of the swinging of the blades rearwardly to their full extended positions. This stopwasher is constructed of a harder material than the shaft of the arrow to minimize wear, and can be easily replaced after it is worn. An annular member, such as a resilient ring, surrounds the tubular body to hold the blades in the longitudinally aligned slots during flight. Notches in the blades prevent displacement of the annular member during arrow acceleration or placement in the arrow quiver.

In use, when the arrowhead hits the target or game, the nose and blades penetrate the surface of the target. After nose penetration, the forward triangular actuating tips of the blades contact the target and forcibly and efficiently swing the blades rearwardly away from the tubular body to reveal the sharpened cutting edges of the blades to cuttingly penetrate the target as forward motion of the arrows proceeds to drive the arrow into the target. The triangular actuating tips provide an angled surface area that transmits the outward forces from the target or game to the blades to cause them to open rearwardly. The forward and rotational motion of the arrowhead causes the blades to open rearwardly to the full extended and incising positions. The extended and deployed blades also prevent the arrowhead from passing through the target or game.

The arrowhead is strong in construction with a light weight that does not alter the longitudinal or concentric balance of the arrow. The movable blades are confined generally (except for the actuating tips) within the body of the arrowhead during the flight of the arrow so that they do not negatively affect arrow flight accuracy due to possible side winds or catch on twigs, branches, leaves, or like obstructions in the field. The blades are offset from the longitudinal axis of the arrowhead body to allow for more complete containment of relatively wide blades within the arrowhead body without significantly weakening it. On a spinning arrow the back exposed edges of the blades in this configuration encounter the side wind at an acute angle and stability is increased while drag is reduced. Accuracy of the arrow is enhanced due to air flow across the triangular actuating tips which imparts additional rotational force to the arrow. Speed of blade opening is increased because rotational momentum increases the torque forcing the blades open as the blade tips impact game. After blade opening, the same offset blade design causes the arrowhead to twistingly enter game utilizing the arrow spiralling energy for cutting and creating a deadly wound channel.

One significant aspect and feature of the present invention is an arrowhead having deployable blades which extend during impact.

Another significant aspect and feature of the present invention is an arrowhead whose deployable blades are sharpened on the cutting edge.

Another significant aspect and feature of the present invention is the use of a resilient ring or annular member to hold the deployable blades in the stowed position for purpose of flight and which is cut or otherwise moved upon arrow impact.

Another significant aspect and feature of the present invention is the use of triangular actuating tips each with an angled surface that generates a great outward force to deploy the blades upon impact with the target.

Another significant aspect and feature of the present invention is the use of triangular actuating tips which generate a rotational force on the arrow due to air flow over the shaft of the arrow during flight.

Another significant aspect and feature of the present invention is an arrowhead which creates an open blade entry wound, thus yielding a better blood trail for a better chance of game tracking and recovery.

Another significant aspect and feature of the present invention is a removable stopwasher that is constructed of a harder material than that of the arrow shaft to serve as a pivotal stop for the blade as it pivots rearwardly upon impact with the target.

Another significant aspect and feature of the present invention is longitudinally aligned slots accommodating the blades which are arranged in planes parallel to but offset from the longitudinal axis of the arrowhead to allow for more complete blade containment within the arrowhead body without significantly compromising its strength. (The plane of each slot does not contain the centerline of the arrow shaft or body.) On a spinning arrow this design reduces drag and turbulence from exposed blade portions and quickens blade opening. On impact it causes the arrowhead to twist during entry.

Another significant aspect and feature of the present invention is generally longitudinally aligned slots to accommodate the blades at an angle of attack with respect to the direction of arrow flight. The planes of these angled slots do not contain the centerline of the arrow shaft, but rather intersect the centerline at a point. The angled slots serve to enhance the arrow rotation during flight more than the slots that are parallel to the centerline.

Another significant aspect and feature of the present invention is blade notches which prevent displacement of the resilient ring or annular member during arrow acceleration and storage in the quiver.

Another significant aspect and feature of the present invention is a sharpened forward edge on the triangular actuating tip to enhance entry into harder target surfaces.

Having thus described embodiments and significant aspects and features of the present invention, it is one object of the present invention to provide an arrowhead with deployable blades.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate the same parts throughout the figures thereof and wherein.

DESCRIPTION OF THE PREFERRED EMBODIMENT

Figure 1:
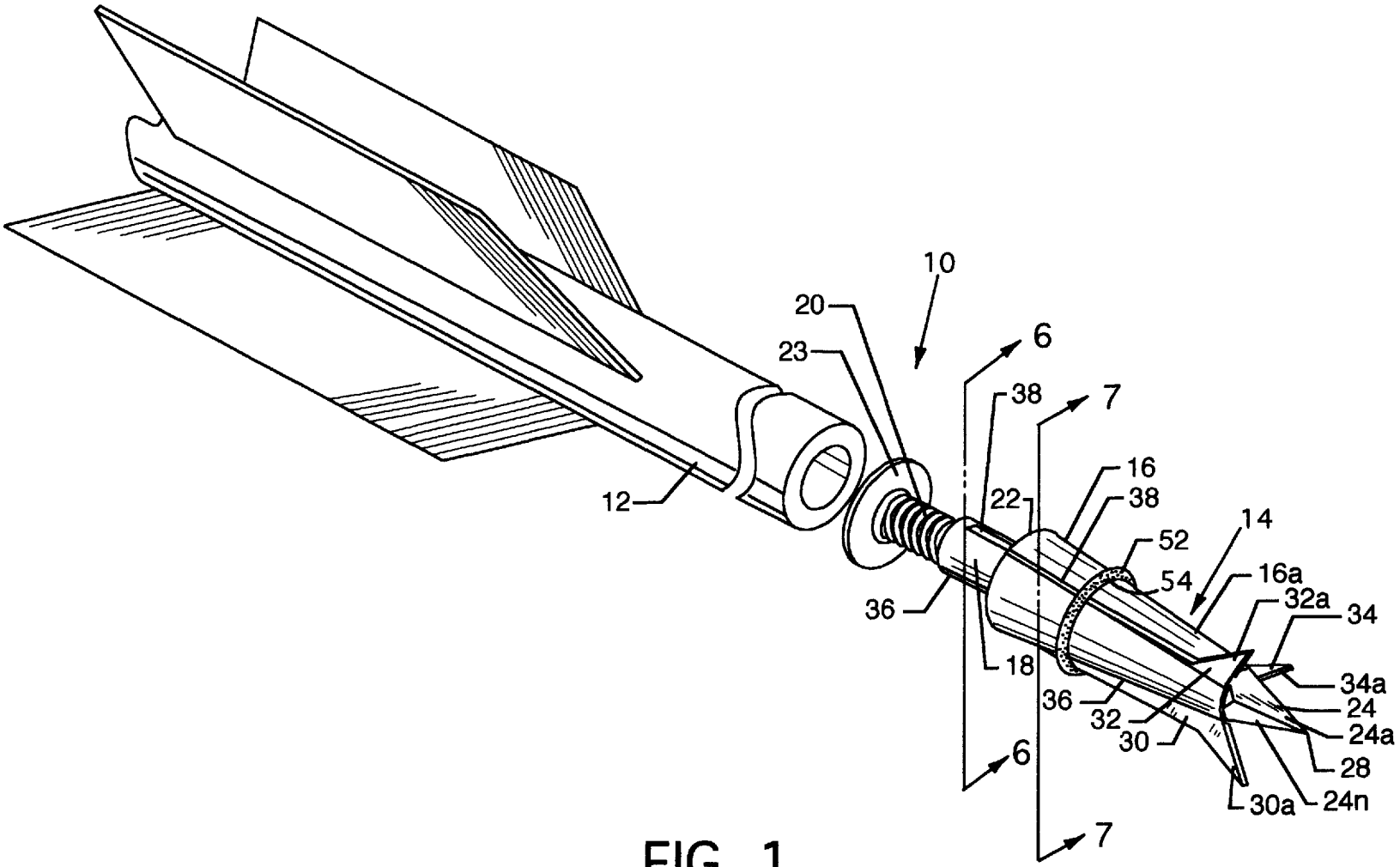
FIG. 1 is a foreshortened perspective view of an arrow equipped with the arrowhead of the present invention and showing the movable blades in the closed and stowed position.
Figure 2:
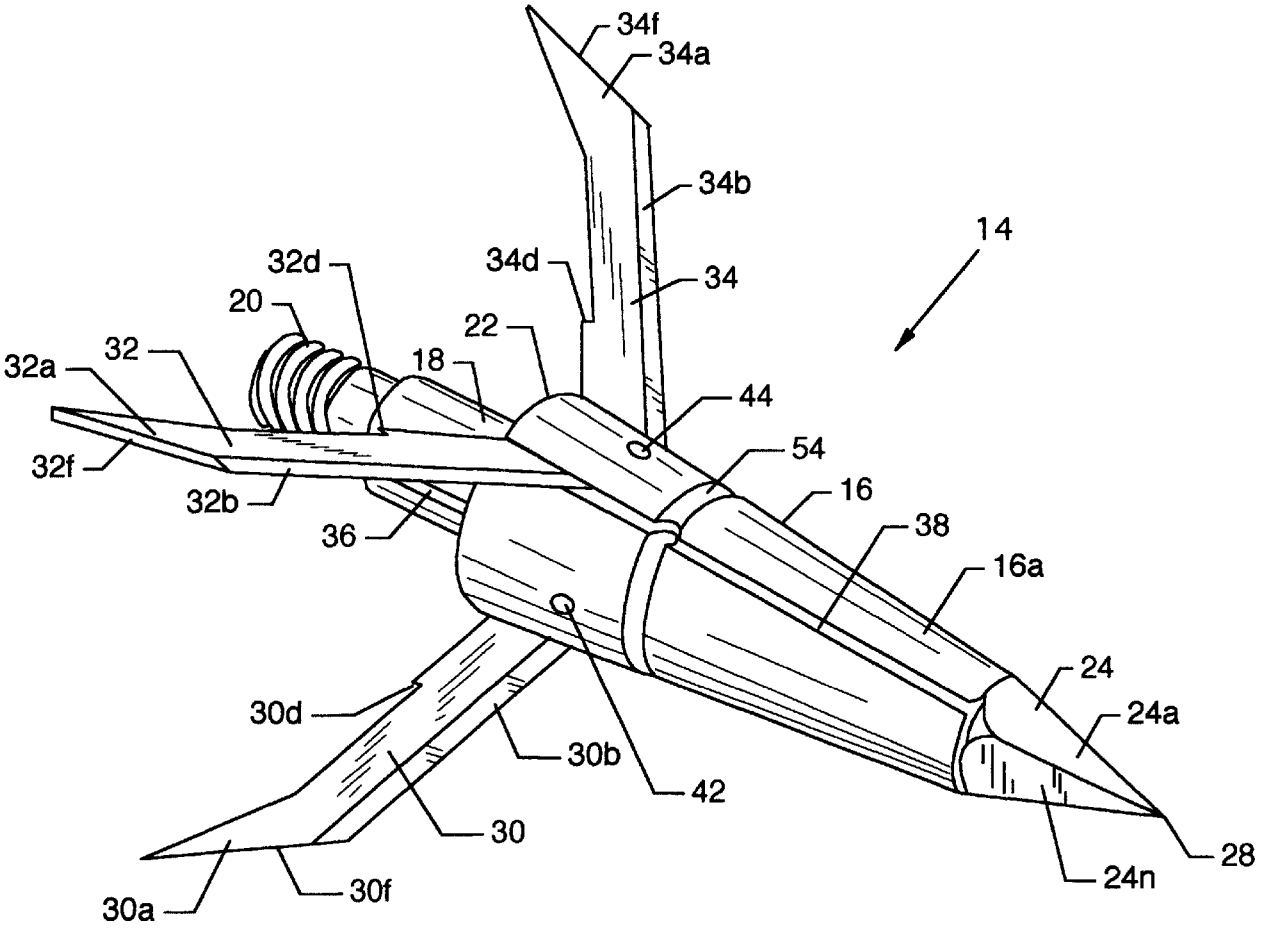
FIG. 2 is a perspective view of the arrowhead of the arrow of FIG. 1 showing the movable blades in the open and deployed position.

Referring to FIGS. 1 and 2, there is shown an arrowhead of the invention indicated generally at 14 attached to a forward end of an arrow 10. Arrow 10 is used for target shooting or large game hunting. The term "game" refers to animals, fowl and fish including, but not limited to, deer, elk, bear, moose, fox, rabbits, coyote, turkey and rodents. Arrowhead 14 causes more rapid hemorrhaging of the game, resulting in quicker death than a conventional hunting arrowhead due to the large cuts inflicted on the game. Arrowhead 14 also prevents arrow 10 from passing through the target or game, minimizing arrow loss and wounded game. Stowing of the blades decreases drag on the front of the arrow and imparts stability and accuracy to the arrow flight.

Figure 5:
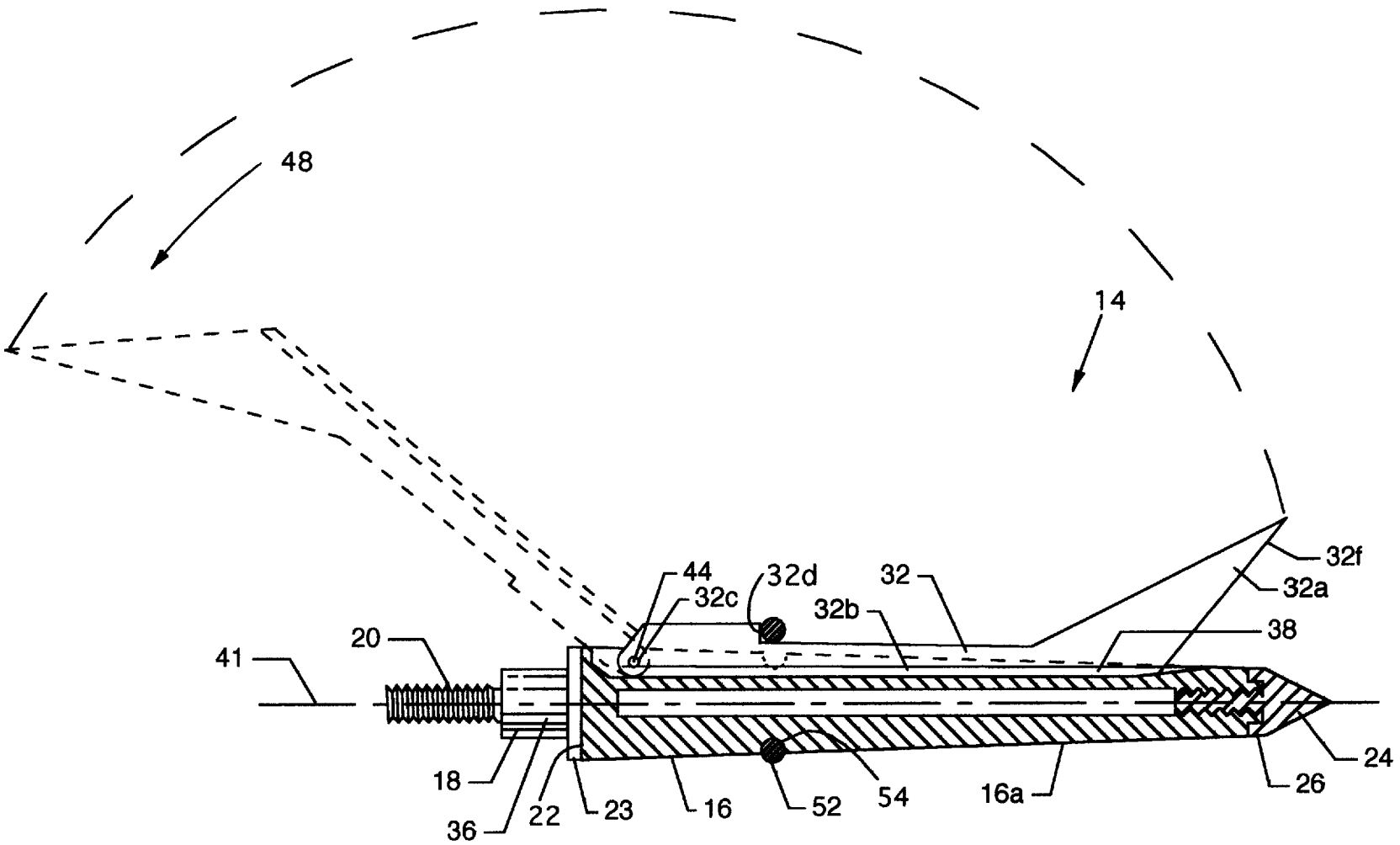
FIG. 5 is an enlarged sectional view taken along line 5—5 of FIG. 3 showing a movable blade in full lines in the closed position and in broken lines in the open position.

Arrow 10 has an elongated tubular shaft 12 attached to arrowhead 14. Shaft 12 is an elongated metal or plastic tubular structure that has internal threads at the forward end thereof. Arrowhead 14 has a tapered body or tubular body 16 having a shaft 18 with a reduced diameter threaded portion 20 that is attached to the forward end of shaft 12. Body 16 is an elongated metal tube that is rotated relative to shaft 12 to remove or attach arrowhead 14 from or to shaft 12. Body 16 has an annular shoulder 22 that engages and captures an easily removable and replaceable stopwasher 23 aligned on shaft 18 between the annular shoulder 22 and the forward end of shaft 12 to hold arrowhead 14 securely on shaft 12. The forward end 16*a* of body 16 is tapered inwardly and attached to a pyramid-like shaped nose 24 having intersecting adjacent surfaces 24*a*–24*n*. The nose 24 has a rearwardly extended threaded end 26 that is accommodated by a threaded bore in the forward end of body 16, as shown in FIG. 5. The outside adjacent intersecting surfaces 24*a*–24*n* of nose 24 taper forwardly to a penetrating point 28. The opposing surfaces 24*a*–24*n* accommodate a tool used to turn the threaded end 26 into the forward end 16*a* of the body 16.

Figure 3:
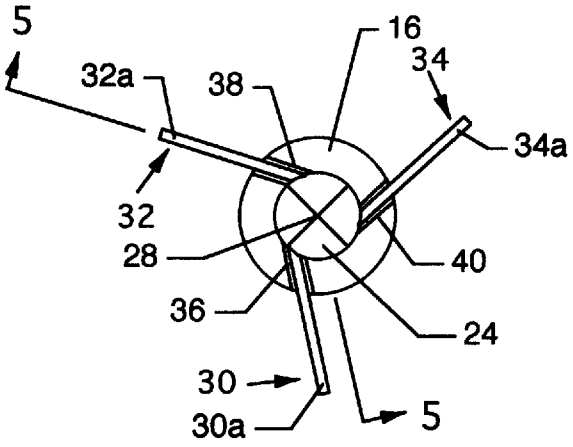
FIG. 3 is a front view of the arrowhead of FIG. 1.
Figure 4:
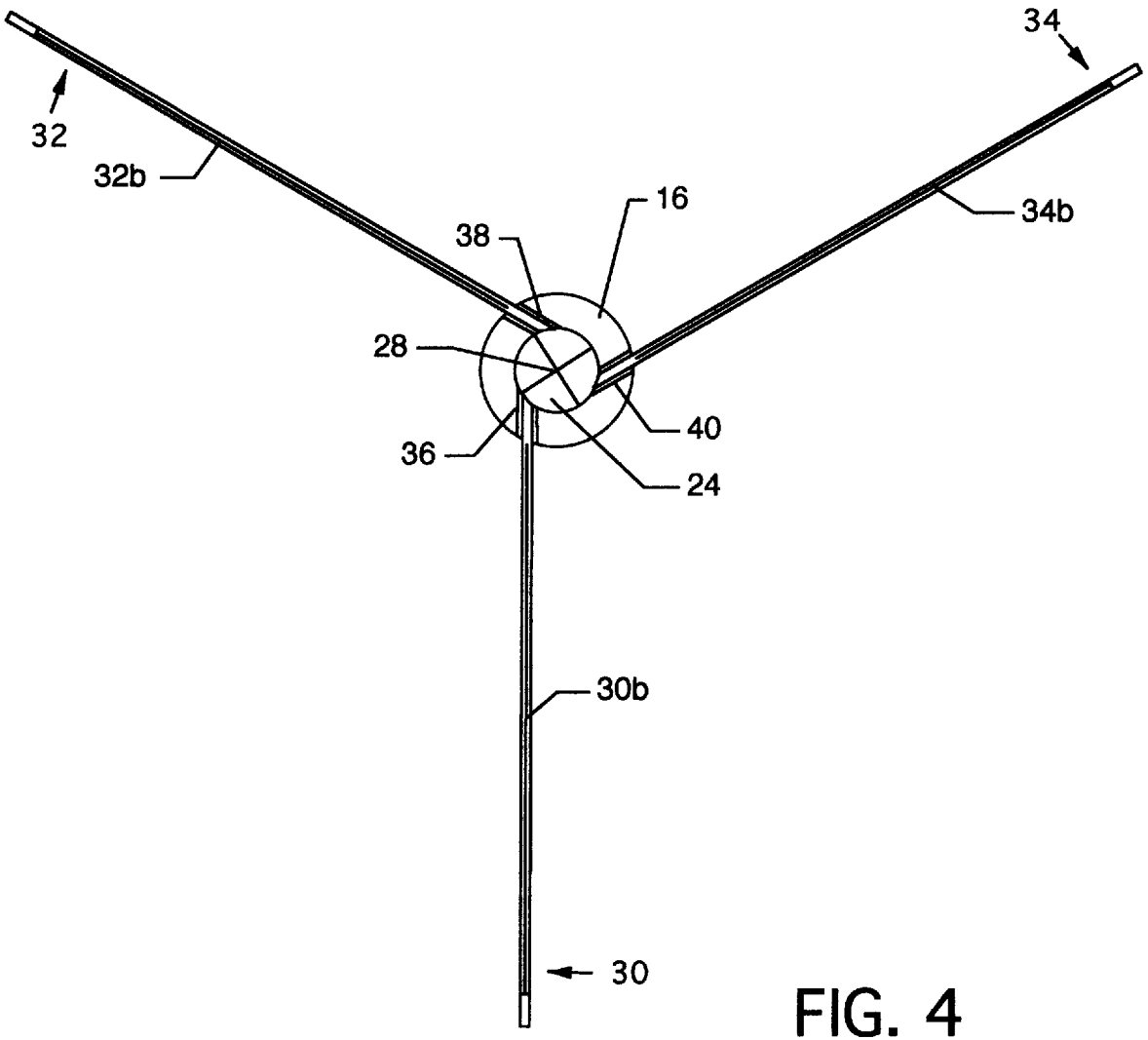
FIG. 4 is a front view of the arrowhead of FIG. 2.

As shown in FIGS. 2, 3 and 4, a plurality of pivoting sharpened blades or knives 30, 32 and 34 are pivotally and otherwise secured to body 16. The blades 30, 32 and 34 have triangular actuating tips 30*a*, 32*a* and 34*a* extending above the general surface of the tapered forward end 16*a* and also include shaped razor-like sharpened edges 30*b*, 32*b* and 34*b* which are exposed upon deployment of the blades 30, 32 and 34 upon impingement of the actuating tips 30*a*, 32*a* and 34*a* upon the target. The triangular actuating tips provide for sharp penetration into the target and generate large outward forces to force the blades outward and rearward. The triangular actuating tips also enhance arrow rotation during flight.

Figure 6:
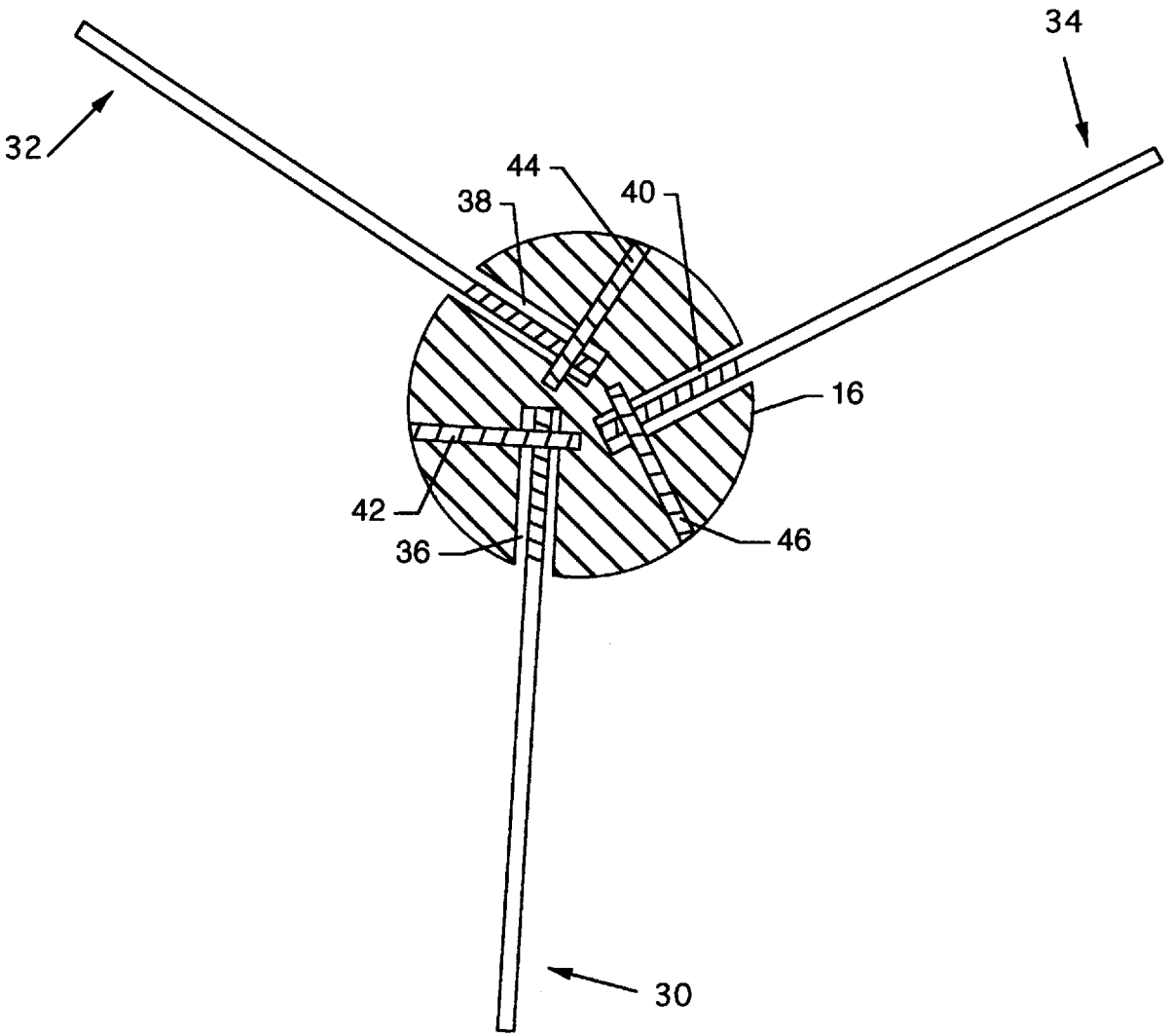
FIG. 6 is an enlarged sectional view taken along line 6—6 of FIG. 1.

Body 16 has a plurality of elongated, generally longitudinal slots 36, 38 and 40 that extend along the tubular body 16. Slots 36, 38 and 40 are parallel to each other at 120° intervals around the tubular body and extend from the forward end of body 16 to the back end of body 16 adjacent to the annular shoulder 22. Slots 36, 38 and 40 extend along planes parallel to but offset from the longitudinal axis of the tubular body. The plane defined by each slot does not contain the centerline 41 (see FIG. 5) of the tubular body. Each slot 36, 38 and 40 which is parallel to the axis accommodates a movable or pivoting blade 30, 32 and 34, respectively. Preferably, arrowhead 14 has three slots 36, 38 and 40 accommodating three pivoting blades 30, 32 and 34, but may optionally include two, four, or as many as six slots to accommodate as many blades. The respective rear end of each blade 30, 32 and 34 is pivoted to body 16 with a bolt or pin 42, 44, 46, as seen in FIG. 6. Pins 42, 44 and 46 are located in bores in body 16 and extend through holes adjacent to the rear ends of blades 30, 32 and 34 allowing the blades 30, 32 and 34 to swing or, as shown by arrow 48 in FIG. 5, pivot between a closed or folded position and an open or extended position. Blades 30, 32 and 34 have rounded rear ends allowing the blades to pivot in slots 36, 38 and 40 when the blades are in the extended position. The stopwasher 23 rearward of slots 36, 38 and 40 functions as a stop limiting backward movement of blades 30, 32 and 34. The stopwasher 23 is a replaceable blade stop for arrowheads with deployable blades. The stopwasher 23, which is constructed of a harder material than the arrow shaft itself, is able to receive the brunt of the force as the blades are forced rearwardly on impact without destroying the shaft of the arrow. As such, the arrowhead may be reusable with the replacement of an inexpensive stopwasher 23. The stopwasher 23 acts as the fulcrum of a lever and converts the rearward force on the blades into a compression force on the rear edge of the pivot pins, so there is little tearing force at the pivot hole in the blades. This allows the blades to be made with very little metal between the sharp edge and the pivot hole, thus enabling the pivot pin to be located further away from the opening at the body outer surface of the slot in a more secure position within the arrowhead body. Blades 30, 32 and 34 have a close fit within, slots 36, 38 and 40 when the blades are in the closed and stowed position. Each blade 30, 32 and 34 is free to pivot to its open position as the arrowhead moves into the target or game, as described later in detail.

Figure 7:
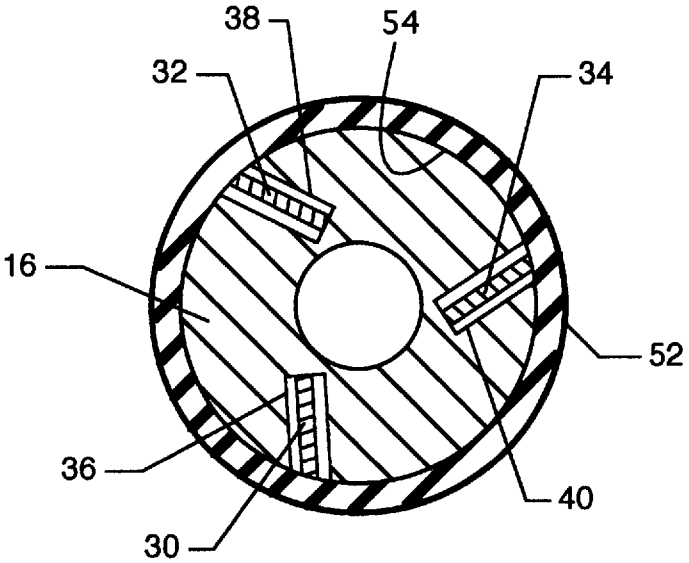
FIG. 7 is an enlarged sectional view taken along line 7—7 of FIG. 1.
Figure 8:
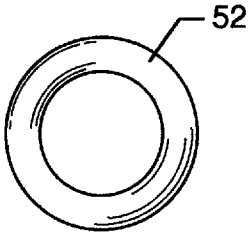
FIG. 8 is a front view of the annular ring for the movable blades.

Referring to FIG. 5, pivoting blade 32 is a generally flat plate with a knife edge 32*b* on its forward and stowed side. When the blade 32 is in the extended position, knife edge 32*b* extends outwardly and rearwardly. Knife edge 32*b* can be at a 45-degree or other desired angle relative to the axis of body 16. The rear portion of blade 32 has a hole 32*c* for accommodating pin 44, as also seen in FIG. 6. Each of blades 30 and 34 has a similar hole for accommodating pins 42 and 46. Returning to FIG. 5, blade 32 has a rounded rear end allowing the blade 32 to pivot in slot 38. The rear portion of blade 32 engages the stopwasher 23 adjacent to slot 38 when blade 32 is in the extended position. This stopwasher 23 stops the backward movement of blade 32. Blade 32 has a generally rectangular shape and has a triangular-shaped actuating tip 32*a*. The actuating tip 32*a* projects outwardly and forwardly from the tapered front portion 16*a* of body 16 when the blade is in the closed or folded position, such as found during flight. The sharpened edge 32*b* of blade 32 is housed below the outer surface of body 16 when the blade 32 is in the closed or stowed position. Blade 32 is held in slot 38 with one or more rings or annular members 52, depending on strength required to hold the blades down, which varies according to speed and acceleration of a launched arrow. A forward facing shoulder surface 30*d*, 32*d* and 34*d* is provided on the respective blades 30, 32 and 34 to serve as a keeper or notch for the ring 52 so that it cannot slide rearward during quiver insertion or arrow flight. As shown in FIG. 7, ring 52 is an elastic band or O-ring of resilient material, such as rubber or plastic, that is expanded over the back end of body 16. Therefore, the ring 52 has an inner diameter smaller than the diameter of body 16. As also seen in FIG. 7, body 16 has an annular groove 54 for accommodating ring 52. Annular groove 54 also aids in preventing the ring 52 from moving forward or backward during quiver extraction or insertion, respectively. In use, ring 52 holds blades 30, 32 and 34 in slots 36, 38 and 40, as shown in FIG. 7. When blades 30, 32 and 34 pivot open, ring 52 expands and rolls backward on the shaft 12 or breaks or is cut, thereby allowing blades 30, 32 and 34 to move to their full open positions as shown in FIGS. 2 and 4. Pivoting blades 30 and 34 are identical in structure and function to blade 32. The forward edges (see 30*f*, 32*f* and 34*f*) of the actuating tips can be sharpened edges to provide for enhanced initial entry into harder target or game surfaces.

MODE OF OPERATION

In use, pivoting blades 30, 32 and 34 are moved to their closed position by locating them into slots 36, 38 and 40. Ring 52 is slipped over the rear end of body 16 and located in annular groove 54 and adjacent to the shoulder surfaces 30*d*, 32*d* and 34*d* so that blades 30, 32 and 34 are held in the body 16 during the shooting of arrow 10. Triangular actuating tips 30*a*, 32*a* and 34*a* of blades 30, 32 and 34 extend outwardly from the front portion 16*a* of body 16 when the blades are in their folded position. The triangular actuating tips enhance arrow rotation during flight. When arrow 10 hits the target or animal, the nose 24 will first penetrate the surface of the target. Triangular actuating tips 30*a*, 32*a* and 34*a* of pivoting blades 30, 32 and 34 will then engage the surface of the target. The forward and rotational force of arrow 10 will cause blades 30, 32 and 34 to pivot outwardly and rearwardly to their expanded position, as shown in FIGS. 2, 4 and 5, exposing knife edges 30*b*, 32*b* and 34*b*. The rear end portions of blades 30, 32 and 34 engage the stopwasher 23 adjoining slots 36, 38 and 40 to hold the blades in their expanded position. Knife edges 30*b*, 32*b* and 34*b* additionally cut the target or the game as the arrowhead moves into the target. The additional cutting of the game increases hemorrhaging of the game, resulting in a quick, humane death. The open or extended blades 30, 32 and 34 also will prevent arrow 10 from passing through the target or game, thereby minimizing arrow loss. When removing arrow 10 from the target or game, blades 30, 32 and 34 pivot inwardly and forwardly. This facilitates removal of arrow 10 from the target or game.

While there has been shown and described a preferred embodiment of the arrowhead with extendable blades, it is understood that changes in materials, size, shape, and arrangement of structure may be made by those skilled in the art without departing from the invention. The forward edges 30*f*, 32*f* and 34*f* of the actuating tips 30*a*, 32*a* and 34*a* can also be sharp.

ALTERNATIVE EMBODIMENT

Figure 9:
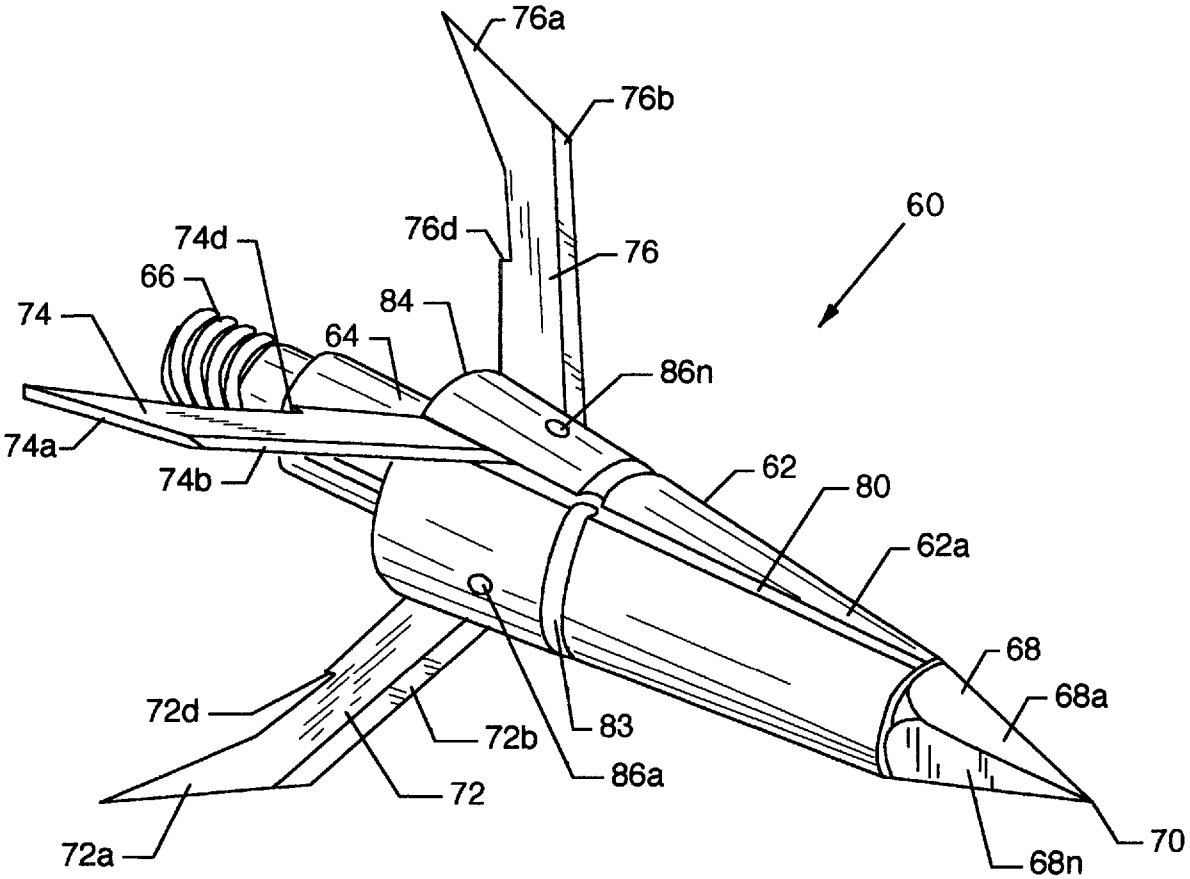
FIG. 9, an alternate embodiment, is a perspective view of an arrowhead showing the movable blades in an open and deployed position; and, FIG. 10 is a front view of the arrowhead of FIG. 9 with the blades in the stowed position.

FIG. 9, an alternate embodiment, illustrates an arrowhead 60 for use with and attachment to the shaft 12 of FIG. 1. The arrowhead 60 has a tapered body or tubular body 62 having a shaft 64 with a reduced diameter threaded portion 66 that is attached to the forward end of the shaft 12. The body 62 is an elongated metal tube that is rotated relative to the shaft 12 to remove or attach the arrowhead 60 from or to the shaft. The forward end 62*a* of the body 62 is tapered to a pyramid-like shaped nose 68 having intersecting adjacent surfaces 68*a*–68*n*. The nose 68 has a rearwardly extended threaded end, similar to threaded end 26 that is illustrated in FIG. 5, which is accommodated by a threaded bore in the forward end 62*a* of the body 62. The outside adjacent intersecting surfaces 68*a*–68*n* of nose 68 taper forwardly to a penetrating point 70. The opposing surfaces 68*a*–68*n* accommodate a tool used to turn the threaded end into the forward end 62*a* of the body 62.

Figure 10:
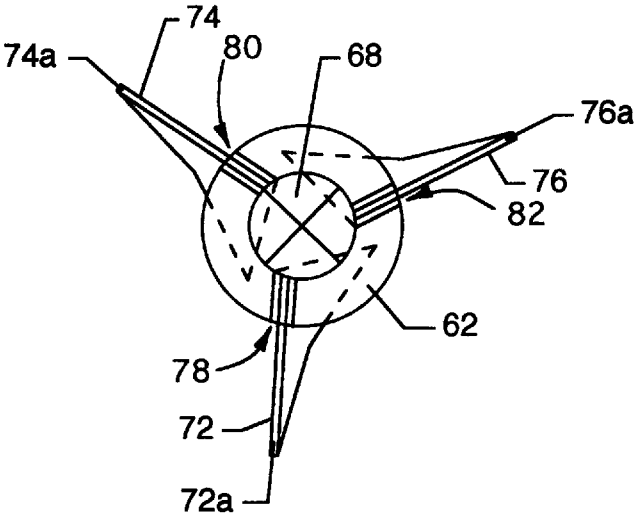

As shown in FIGS. 9 and 10 a plurality of pivoting sharpened blades or knives 72, 74 and 76 are pivotally and otherwise secured to body 62. The blades 72, 74 and 76 have triangular actuating tips 72*a*, 74*a* and 76*a* extending above the general surface of the tapered forward end 62*a* and also include shaped razor-like sharpened surfaces 72*b*, 74*b* and 76*b* which are exposed upon deployment of the blades 72, 74 and 76 upon impingement of the actuating tips 72*a*, 74*a* and 76*a* upon the target.

Body 62 has a plurality of elongated, generally obliquely aligned slots 78, 80 and 82 that extend along the tubular body 62. Slots 78, 80 and 82 are substantially parallel to each other at 120° intervals around the tubular body 62 and extend from the forward end 62*a* of body 62 to the back end of body 62 adjacent to an annular shoulder 84. Slots 78, 80 and 82 extend at an angle with respect to the chord planes of the tubular body 62. The planes defined by each slot do not contain the centerline 130 (FIG. 11) of the tubular body (i.e., they are offset) and are not parallel with the centerline. Each slot 78, 80 and 82 accommodates a movable or pivoting blade 72, 74 and 76, respectively. Preferably, arrowhead 60 has three slots 78, 80 and 82 accommodating three pivoting blades 72, 74 and 76, but may optionally include four slots to accommodate four blades. The respective rear end of each blade 72, 74 and 76 is pivoted to body 62 with a bolt or pin 86*a*–86*n*, as seen in FIG. 9. Pins 86*a*–86*n* are located in bores in body 62 and extend through holes adjacent to the rear ends of blades 72, 74 and 76 allowing the blades 72, 74 and 76 to swing between a closed or folded position and an open or extended position. Blades 72, 74 and 76 have rounded rear ends allowing the blades to pivot in slots 78, 80 and 82 when the blades are in the extended position. The stopwasher of previous FIGS. 1 and 5 rearward of the slots 78, 80 and 82 functions as a stop for limiting backward movement of the blades 72, 74 and 76, as previously described. Forward facing shoulder surfaces 72*d*, 74*d*, and 76*d* provide notches which contribute along with annular groove 83 for accommodation of an elastic ring similar to ring 52.

FIG. 10 illustrates a front view of the arrowhead 60 of FIG. 9 with the blades in the stowed position, where all numerals correspond to those elements previously described. The blades 72, 74 and 76 instead of being streamlined to the flight path are aligned in an oblique fashion with respect to the centerline and to the chord planes. The stowed blades, having an angle with respect to the centerline, present an angle of attack of the stowed but slightly exposed blades 72, 74 and 76 with respect to the flight path. When the arrow is in flight, the blades 72, 74 and 76 present an angle of attack to the relative air flow passing across the blades, thus imparting a rotational movement to the shaft of the arrow. Properly aligned arrow feathers can also impart a rotational movement about the longitudinal axis of the arrow. The combination of these rotational forces causes a rapid spinning effect likened to that which rifling produces.

Both embodiments have the blade planes "offset" relative to the center axis of the arrowhead. This allows for a more complete containment of a wide blade within a small body and smoothed air flow over the protruding back edges of the blades in flight in stowed position. It also causes the blades to twistingly penetrate during entry. The offset helps to "peel" the blades open on impact.

Various modifications can be made to the present invention without departing from the apparent scope hereof. The arrow can have from 2–6 blades. Any of the edges of the blade can be sharp.

10 arrow
12 tubular shaft
14 arrowhead
16 tapered body or tubular body
16*a* forward end or front portion
18 shaft
20 threaded portion
22 annular shoulder
23 stopwasher
24 nose
24*a–n* adjacent surfaces
26 threaded end
28 penetrating point
30 blade
32 blade
34 blade
30*a* triangular actuating tip
32*a* triangular actuating tip
34*a* triangular actuating tip
30*b* sharpened edge or knife edge
32*b* sharpened edge or knife edge
34*b* sharpened edge or knife edge
32*c* hole
30*d* forward facing shoulder surface
32*d* forward facing shoulder surface
34*d* forward facing shoulder surface
30*f* forward edge of actuating tip
32*f* forward edge of actuating tip
34*f* forward edge of actuating tip
36 slot
38 slot
40 slot
41 centerline
42 pin
44 pin
46 pin
48 arrow
52 ring or annular member
54 annular groove
60 arrowhead
62 tapered body or tubular body
62*a* forward end
64 shaft
66 threaded portion
68 nose
68*a–n* adjacent surfaces
70 penetrating point
72 blade
74 blade
76 blade
72*a* triangular actuating tip
74*a* triangular actuating tip
76*a* triangular actuating tip
72*b* sharpened surface
74*b* sharpened surface
76*b* sharpened surface
72*d* forward facing shoulder surface
74*d* forward facing shoulder surface
76*d* forward facing shoulder surface
78 slot
80 slot
82 slot
83 annular groove
84 annular shoulder
86*a–n* pins

I claim:

1. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a replaceable stopwasher constructed of a material harder than that of the arrow shaft and positioned over said arrowhead shaft making direct contact with said annular shoulder and for making direct contact with the forward end of the arrow shaft;

e. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end; and, (2) at least two slots in said tapered tubular body extending longitudinally from said rearward end to said forward end at a depth less than either of said rearward end and forward end diameters of said tapered tubular body, each slot forming a plane that is parallel to, but offset from, said centerline of said tapered tubular body;

f. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game; and, (4) a back edge that faces away from said slot in the folded position, said back edge having a forward facing shoulder surface that forms a notch, and said back edge impacting on said replaceable stopwasher when said blades are in the extended position;

g. a nose with a penetrating point attached to said forward end of said tapered tubular body; and, h. a resilient ring that extends around the perimeter of said tapered tubular body with the blades residing in their folded position, said ring passing through said notches in said back edges of said blades, thereby maintaining said blades in said folded position during flight.

2. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and forward end, said rearward end joined to said portion;

c. an annular shoulder joined to said forward end of said arrowhead shaft;

d. a replaceable stopwasher constructed of a material harder than that of the arrow shaft and positioned over said arrowhead shaft making direct contact with said annular shoulder and for making direct contact with the forward end of the arrow shaft;

e. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is offset from said centerline of said tapered tubular body and is not parallel to said centerline, to further enhance rotation of the arrow during flight; and, (3) an annular groove located in the outer surface of said tapered tubular body to accommodate a resilient ring;

f. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game and provides enhanced rotational forces during arrow flight; and, (4) a back edge that faces away from said slot in the folded position, said back edge having a forward facing shoulder surface that forms a notch to hold the resilient ring from rearward longitudinal movement during arrow flight, and said back edge impacting on said replaceable stopwasher when said blades are in the extended position;

g. a nose with a penetrating point attached to said forward end of said tapered tubular body; and, h. a resilient ring that extends around the perimeter of said tapered tubular body with the blades residing in their folded position, said ring passing through said notches in said back edges of said blades and through said annular groove in said tapered tubular body, thereby maintaining said blades in said folded position during flight.

3. The arrowhead of claim 1 or 2, wherein said forward edge of said triangular actuating tip has a sharpened edge.

4. The arrowhead of claim 1 or 2, wherein said arrowhead contains three blades.

5. The arrowhead of claim 1 or 2, wherein said arrowhead contains four blades.

6. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a replaceable stopwasher constructed of a material harder than that of the arrow shaft and positioned over said arrowhead shaft making direct contact with said annular shoulder and for making direct contact with the forward end of the arrow shaft;

e. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is not parallel to said centerline; and, (3) an annular groove located in the outer surface of said tapered tubular body to accommodate a resilient ring;

f. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game and provides enhanced rotational forces during arrow flight; and, (4) a back edge that faces away from said slot in the folded position, said back edge having a forward facing shoulder surface that forms a notch to hold the resilient ring from rearward longitudinal movement during arrow flight, and said back edge impacting on said replaceable stopwasher when said blades are in the extended position;

g. a nose with a penetrating point attached to said forward end of said tapered tubular body; and, h. a resilient ring that extends around the perimeter of said tapered tubular body with the blades residing in their folded position, said ring passing through said notches in said back edges of said blades and through said annular groove in said tapered tubular body, thereby maintaining said blades in said folded position during flight.

7. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is parallel to said centerline of said tapered tubular body; and (3) an annular groove located in the outer surface of said tapered tubular body to accommodate a resilient ring;

e. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game; and, (4) a back edge that faces away from said slot in the folded position;

f. a nose with a penetrating point attached to said forward end of said tapered tubular body; and, g. a resilient ring that extends around the perimeter of said tapered tubular body with the blades residing in their folded position, wherein, said back edge of each blade contains a notch to hold said resilient ring from moving longitudinally alone said tapered tubular body during flight.

8. The arrowhead of claim 7, wherein said planes of said slots are offset from said centerline of said tapered tubular body.

9. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is parallel to said centerline of said tapered tubular body; and (3) an annular groove located in the outer surface of said tapered tubular body to accommodate a resilient ring;

e. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game; and, (4) a back edge that faces away from said slot in the folded position;

f. a nose with a penetrating point attached to said forward end of said tapered tubular body;

g. a resilient ring that extends around the perimeter of said tapered tubular body with the blades residing in their folded position; and, h. a replaceable stopwasher constructed of a material harder than that of the arrow shaft and positioned over said arrowhead shaft which provides an impact surface to said blades in the extended position.

10. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is parallel to said centerline of said tapered tubular body; and, (3) an annular groove located in the outer surface of said tapered tubular body to accommodate a resilient ring;

e. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position; and, (3) a back edge that faces away from said slot in the folded position, said back edge having a forward facing shoulder surface that forms a notch to hold the resilient ring from rearward longitudinal movement during arrow flight;

f. a nose with a penetrating point attached to said forward end of said tapered tubular body; and, g. a resilient ring that extends around the perimeter of said tapered tubular body with the blades residing in their folded position, said ring passing through said notches in said back edges of said blades and through said annular groove in said tapered tubular body, thereby maintaining said blades in said folded position during flight.

11. The arrowhead of claim 10, wherein said planes of said slots are offset from said centerline of said tapered tubular body.

12. The arrowhead of claim 10, wherein a replaceable stopwasher constructed of a material harder than that of the arrow shaft and positioned over said arrowhead shaft provides an impact surface to said blades in the extended position.

13. The arrowhead of claim 10, wherein each blade has a triangular actuating tip located at its forward end with a forward edge that forces the blade outward upon impact with a target or game.

14. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is parallel to, but offset from, said centerline of said tapered tubular body; and (3) an annular groove located in the outer surface of said tapered tubular body to accommodate a resilient ring;

e. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position; and, (3) a back edge that faces away from said slot in the folded position;

f. a nose with a penetrating point attached to said forward end of said tapered tubular body; and, g. a resilient ring that extends around the perimeter of said tapered tubular body with the blades residing in their folded position, wherein, said back edge of each blade contains a notch to hold said resilient ring from moving longitudinally along said tapered tubular body during flight.

15. The arrowhead of claim 14, wherein each blade has a triangular actuating tip located at its forward end with a forward edge that forces the blade outward upon impact with a target or game.

16. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is parallel to, but offset from, said centerline of said tapered tubular body; and (3) an annular groove located in the outer surface of said tapered tubular body to accommodate a resilient ring;

e. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position; and, (3) a back edge that faces away from said slot in the folded position;

f. a nose with a penetrating point attached to said forward end of said tapered tubular body;

g. a resilient ring that extends around the perimeter of said tapered tubular body with the blades residing in their folded position; and, h. a replaceable stopwasher constructed of a material harder than that of the arrow shaft and positioned over said arrowhead shaft which provides an impact surface to said blades in the extended position.

17. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a replaceable stopwasher constructed of a material harder than that of the arrow shaft and positioned over said arrowhead shaft making direct contact with said annular shoulder and for making direct contact with the forward end of the arrow shaft;

e. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is parallel to said centerline of said tapered tubular body; and, (3) an annular groove located in the outer surface of said tapered tubular body to accommodate a resilient ring;

f. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position; and, (3) a back edge that faces away from said slot in the folded position, said back edge impacting on said replaceable stopwasher when said blades are in the extended position;

g. a nose with a penetrating point attached to said forward end of said tapered tubular body; and, h. a resilient ring that extends around the perimeter of said tapered tubular body with the blades residing in their folded position.

18. The arrowhead of claim 17, wherein said planes of said slots are offset from said centerline of said tapered tubular body.

19. The arrowhead of claim 17, wherein said back edge of each blade contains a notch to hold said resilient ring from moving longitudinally along said tapered tubular body during flight.

20. The arrowhead of claim 17, wherein each blade has a triangular actuating tip located at its forward end with a forward edge that forces the blade outward upon impact with a target or game.

21. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a replaceable stopwasher constructed of a material harder than that of the arrow shaft and positioned over said arrowhead shaft making direct contact with said annular shoulder and for making direct contact with the forward end of the arrow shaft;

e. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane that is offset from said centerline of said tapered tubular body and is not parallel to said centerline, to further enhance rotation of the arrow during flight; and, (3) an annular groove located in the outer surface of said tapered tubular body to accommodate a resilient ring;

f. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game and provides enhanced rotational forces during arrow flight; and, (4) a back edge that faces away from said slot in the folded position, and said back edge impacting on said replaceable stopwasher when said blades are in the extended position;

g. a nose with a penetrating point attached to said forward end of said tapered tubular body; and, h. a resilient ring that extends around the perimeter of said tapered tubular body with the blades residing in their folded position, said ring passing through said annular groove in said tapered tubular body, thereby maintaining said blades in said folded position during flight.

22. An arrowhead with rearwardly pivoting blades that provide a low profile aerodynamic shape during arrow flight and a larger cutting diameter during contact with a target or game, comprising:

a. a portion that attaches to the forward end of an arrow shaft;

b. an arrowhead shaft having a rearward end and a forward end, said rearward end joined to said portion;

c. an annular shoulder joined to said forward end of said arrowhead shaft;

d. a replaceable stopwasher constructed of a material harder than that of the arrow shaft and positioned over said arrowhead shaft making direct contact with said annular shoulder and for making direct contact with the forward end of the arrow shaft;

e. a tapered tubular body with a rearward end and a forward end and a centerline extending longitudinally on center from said rearward end to said forward end, said rearward end being adjacent to said annular shoulder, comprising:

(1) a diameter of said rearward end being similar in size to the diameter of the arrow shaft and a diameter of said forward end being smaller than the diameter of said rearward end;

(2) at least two slots in said tapered tubular body extending longitudinally from said rearward end to said forward end at a depth less than either of said rearward end and forward end diameters of said tapered tubular body, each slot forming a plane; and, (3) an annular groove located in the outer surface of said tapered tubular body to accommodate a resilient ring;

f. at least two blades which pivot rearwardly from a folded position housed to a large degree within said slots during flight to an extended position during impact with a target or game, each blade comprising:

(1) a forward end which resides near said forward end of said tapered tubular body and a rearward end pivotally connected to said rearward end of said tapered tubular body;

(2) a sharpened frontal edge that faces into said slot in the folded position;

(3) a triangular actuating tip located at the forward end of said blade with a forward edge that forces said blade outward upon impact with a target or game; and, (4) a back edge that faces away from said slot in the folded position, said back edge having a forward facing shoulder surface that forms a notch to hold the resilient ring from rearward longitudinal movement during arrow flight, and said back edge impacting on said replaceable stopwasher when said blades are in the extended position;

g. a nose with a penetrating point attached to said forward end of said tapered tubular body; and, h. a resilient ring that extends around the perimeter of said tapered tubular body with the blades residing in their folded position, said ring passing through said notches in said back edges of said blades and through said annular groove in said tapered tubular body, thereby maintaining said blades in said folded position during flight.

* * * * *